US009150945B2

(12) United States Patent
Bei

(10) Patent No.: US 9,150,945 B2
(45) Date of Patent: Oct. 6, 2015

(54) MULTI-COMPONENT SOLID SOLUTION ALLOYS HAVING HIGH MIXING ENTROPY

(75) Inventor: Hongbin Bei, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 488 days.

(21) Appl. No.: 13/283,078

(22) Filed: Oct. 27, 2011

(65) Prior Publication Data

US 2013/0108502 A1 May 2, 2013

(51) Int. Cl.

| | |
|---|---|
| ***C22C 9/04*** | (2006.01) |
| ***C22C 30/00*** | (2006.01) |
| ***C22C 1/02*** | (2006.01) |
| ***C22C 9/06*** | (2006.01) |
| ***C22C 19/05*** | (2006.01) |
| ***C22C 19/07*** | (2006.01) |
| ***C22C 27/02*** | (2006.01) |
| ***C22C 27/06*** | (2006.01) |
| ***C22C 30/02*** | (2006.01) |

(52) U.S. Cl.

CPC . *C22C 30/00* (2013.01); *C22C 1/02* (2013.01); *C22C 9/06* (2013.01); *C22C 19/05* (2013.01); *C22C 19/07* (2013.01); *C22C 27/02* (2013.01); *C22C 27/06* (2013.01); *C22C 30/02* (2013.01)

(58) Field of Classification Search

USPC ..... 420/580, 591; 148/442
IPC ..... C22C 30/00
See application file for complete search history.

(56) References Cited

U.S. PATENT DOCUMENTS

| | | | | |
|---|---|---|---|---|
| 4,589,937 | A * | 5/1986 | Jackson et al. | 148/404 |
| 6,177,046 | B1 * | 1/2001 | Simkovich et al. | 420/444 |
| 2002/0159914 | A1 * | 10/2002 | Yeh | 420/580 |

FOREIGN PATENT DOCUMENTS

JP 09157777 * 6/1997

OTHER PUBLICATIONS

J. W. Yeh, et al., "Nanostructured high-entropy alloys with multiple principal elements: Novel alloy design concepts and outcomes" Adv. Eng. Mater, 6, 299-304 (2004).

J. W. Yeh, et al., "Formation of simple crystal structures in Cu—Co—Ni—Cr—Al—Fe—Ti—V alloys with multiprincipal metallic elements" Metall. Mater. Trans. A, 35, 1465-1469 (2004).

Y. J. Zhou, et al., "Solid solution alloys of AlCoCrFeNiTix with excellent room-temperature mechanical properties"Appl. Phys. Lett., 90, 181904 (2007).

(Continued)

*Primary Examiner* — Sikyin Ip

(74) *Attorney, Agent, or Firm* — Novak Druce Connolly Bove + Quigg LLP

(57) ABSTRACT

A multi-component high-entropy alloy includes a composition selected from the following group: VNbTaTiMoWRe, VNbTaTiMoW, VNbTaTiMoRe, VNbTaTiWRe, VNbTaMoWRe, VNbTiMoWRe, VTaTiMoWRe, NbTaTiMoWRe, VNbTaTiMo, VNbTaTiW, VNbTaMoW, VNbTiMoW, VTaTiMoW, NbTaTiMoW, VNbTaTiRe, VNbTaMoRe, VNbTiMoRe, VTaTiMoRe, NbTaTiMoRe, VNbTaWRe, VNbTiWRe, VTaTiWRe, NbTaTiWRe, VNbMoWRe, VTaMoWRe, NbTaMoWRe, VTiMoWRe, NbTiMoWRe, TaTiMoWRe, wherein relative amounts of each element vary by no more than ±15 atomic %.

2 Claims, 18 Drawing Sheets

| | V | Nb | Ta | Mo | W | Ti | Re | Cr | Zr | Hf |
|---|---|---|---|---|---|---|---|---|---|---|
| V | | — | — | — | — | — | / | — | x | x |
| Nb | — | | — | — | — | — | / | x | — | — |
| Ta | — | — | | — | — | — | / | x | — | — |
| Mo | — | — | — | | — | — | / | — | x | x |
| W | — | — | — | — | | — | / | — | x | x |
| Ti | — | — | — | — | — | | / | x | — | — |
| Re | / | / | / | / | / | / | | / | x | x |
| Cr | — | x | x | — | — | x | / | | x | x |
| Zr | x | — | — | x | x | — | x | x | | — |
| Hf | x | — | — | x | x | — | x | x | — | |

(56) References Cited

OTHER PUBLICATIONS

Y. Zhang, et al., "Solid-solution phase formation rules for multicomponent alloys" Adv. Eng. Mater., 10, 534-538 (2008).

Liu, S. Guo, et al., "Micromechanical Characterization of Casting Induced Inhomogeneity in an A10.8CoCrCuFeNi High Entropy Alloy", Scripta Materialia (2011), doi: 10.1016/j.scriptamat.2011.01.020.

* cited by examiner

| | Ni | Co | Mn | Cr | Fe | Cu | Au | Al | Nb |
|---|---|---|---|---|---|---|---|---|---|
| Ni | | – | – | – | – | – | – | x | x |
| Co | – | | – | – | – | x | x | x | x |
| Mn | – | – | | / | – | – | / | / | x |
| Cr | – | – | / | | – | x | / | / | x |
| Fe | – | – | – | – | | x | / | / | x |
| Cu | – | x | – | x | x | | – | x | x |
| Au | – | x | / | / | / | – | | x | / |
| Al | x | x | / | / | / | x | x | | x |
| Nb | x | x | x | x | x | x | / | x | |

FIG. 14

| | V | Nb | Ta | Mo | W | Ti | Re | Cr | Zr | Hf |
|---|---|---|---|---|---|---|---|---|---|---|
| V | | – | – | – | – | – | / | – | x | x |
| Nb | – | | – | – | – | – | / | x | – | – |
| Ta | – | – | | – | – | – | / | x | – | – |
| Mo | – | – | – | | – | – | / | – | x | x |
| W | – | – | – | – | | – | / | – | x | x |
| Ti | – | – | – | – | – | | / | x | – | – |
| Re | / | / | / | / | / | / | | / | x | x |
| Cr | – | x | x | – | – | x | / | | x | x |
| Zr | x | – | – | x | x | – | x | x | | – |
| Hf | x | – | – | x | x | – | x | x | – | |

FIG. 15

MULTI-COMPONENT SOLID SOLUTION ALLOYS HAVING HIGH MIXING ENTROPY

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

CROSS-REFERENCE TO RELATED APPLICATIONS

None

NAMES OF PARTIES TO A JOINT RESEARCH AGREEMENT

None

BACKGROUND OF THE INVENTION

Solid solution strengthening is one of the most important methods to enhance the strength of materials by alloying other elements into pure metals but still remain entirely as a solution. The strengthening effect is achieved by interacting a solute atom with dislocations either through an atomic size misfit or a modulus misfit. Unlike precipitation or strain (work) strengthened materials, which lose their strength in high temperature due to precipitation growth and strain relaxation in recovering and recrystallization at high temperature, solid solution alloying thus is practically useful in designing structural materials specially for high temperature use. Most commercially available solid solution alloys contain 2 to 3 elements, e.g. Ta-10W and Ta-8W-2Hf, with one element being the major component. Recently, a new type of structural materials has been identified as multi-component high-entropy alloys (HEAs) which normally comprise more than four metal elements with approximately equiatomic ratio, resulting in high entropy of mixing. When all elements in an alloy have an equal atomic ratio, the configuration entropy (also called mixing entropy), $\Delta S_{mix}$, will reach its maximum value $\Delta S_{mix}$=RInN (N is the number of elements and R the gas constant). Such alloys may have unique physical and mechanical properties because they still have simple crystal structure but their lattices were highly distorted due to atomic size misfit. The dislocation structures that govern material plasticity may be completely different from the traditional alloys.

BRIEF SUMMARY OF THE INVENTION

In accordance with one aspect of the present invention, the foregoing and other objects are achieved by a multi-component high-entropy alloy includes a composition selected from the following group: VNbTaTiMoWRe, VNbTaTiMoW, VNbTaTiMoRe, VNbTaTiWRe, VNbTaMoWRe, VNbTiMoWRe, VTaTiMoWRe, NbTaTiMoWRe, VNbTaTiMo, VNbTaTiW, VNbTaMoW, VNbTiMoW, VTaTiMoW, NbTaTiMoW, VNbTaTiRe, VNbTaMoRe, VNbTiMoRe, VTaTiMoRe, NbTaTiMoRe, VNbTaWRe, VNbTiWRe, VTaTiWRe, NbTaTiWRe, VNbMoWRe, VTaMoWRe, NbTaMoWRe, VTiMoWRe, NbTiMoWRe, TaTiMoWRe, wherein relative amounts of each element vary by no more than ±15 atomic %.

BRIEF DESCRIPTION OF THE DRAWINGS

FIG. 14 is a Schematic diagram showing where the single phase solid solution HEAs located for alloys comprises Ni, Co, Mn, Cr, Fe, Au, Al and Nb. Symbol "-" represents very large solid solubility in both side in a binary phase diagram, e.g., Ni—Co. Symbol "/" represents very large solid solubility only in one side, e.g., Cr—Mn. Symbol "X" refers to the solubility is small either because of phase separation or formation of intermetallic compounds, e.g., Fe—Cu, Fe—Nb, etc. The region with symbol "-" and "/" is the possible elements, which is FeCrNiCoMn alloy.

FIG. 15 is a schematic diagram illustrating a new family of single phase solid solution HEA based on elements of V, Ti, Nb, Ta, Mo, W and Re. Symbols "-", "/" and "X" have the same meanings as in FIG. 14.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 1:
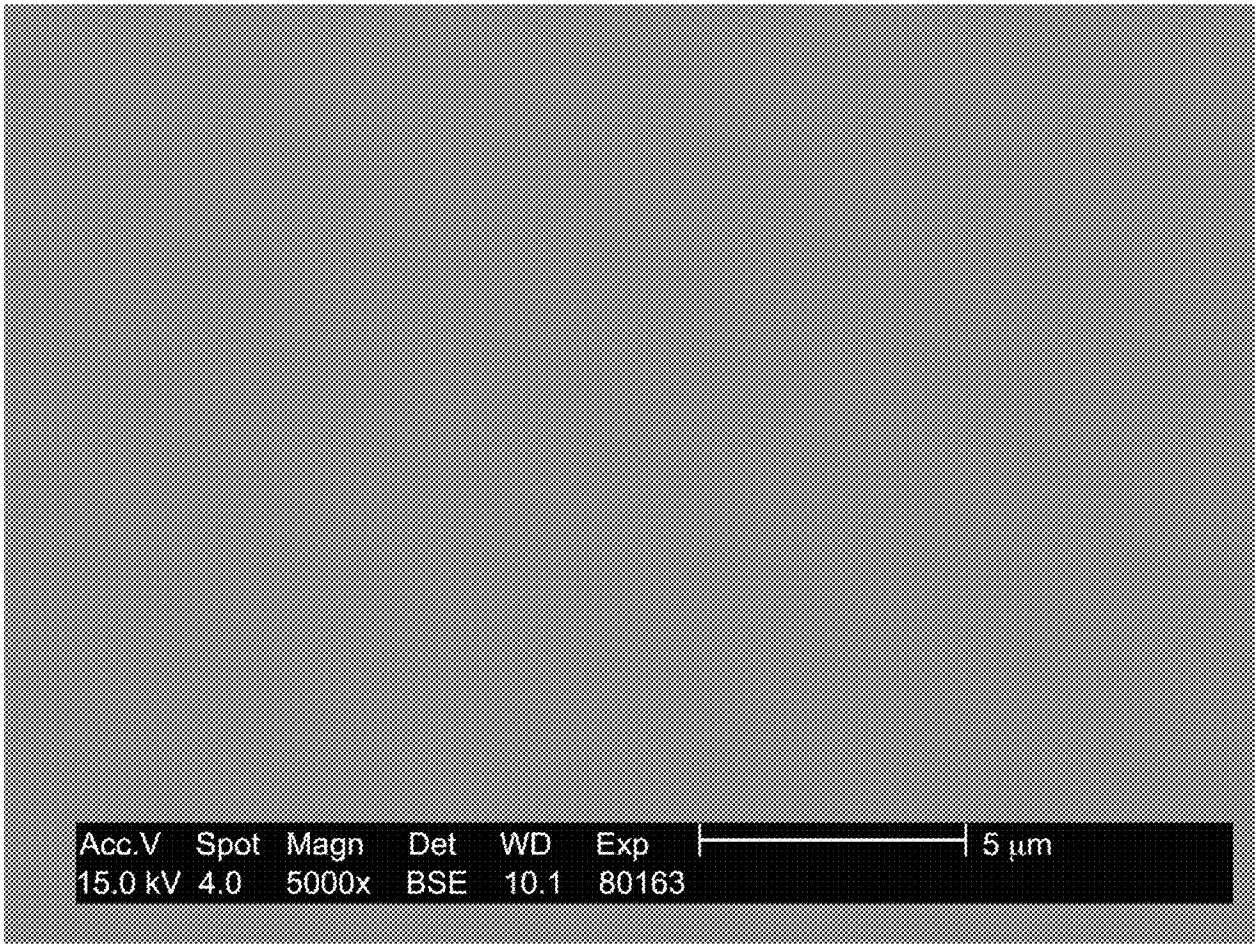
FIG. 1 is a backscattered electron image (BSE) of a single crystal FeCoNiCr alloy grown in an optical floating zone furnace showing single-phase microstructure.
Figure 2:
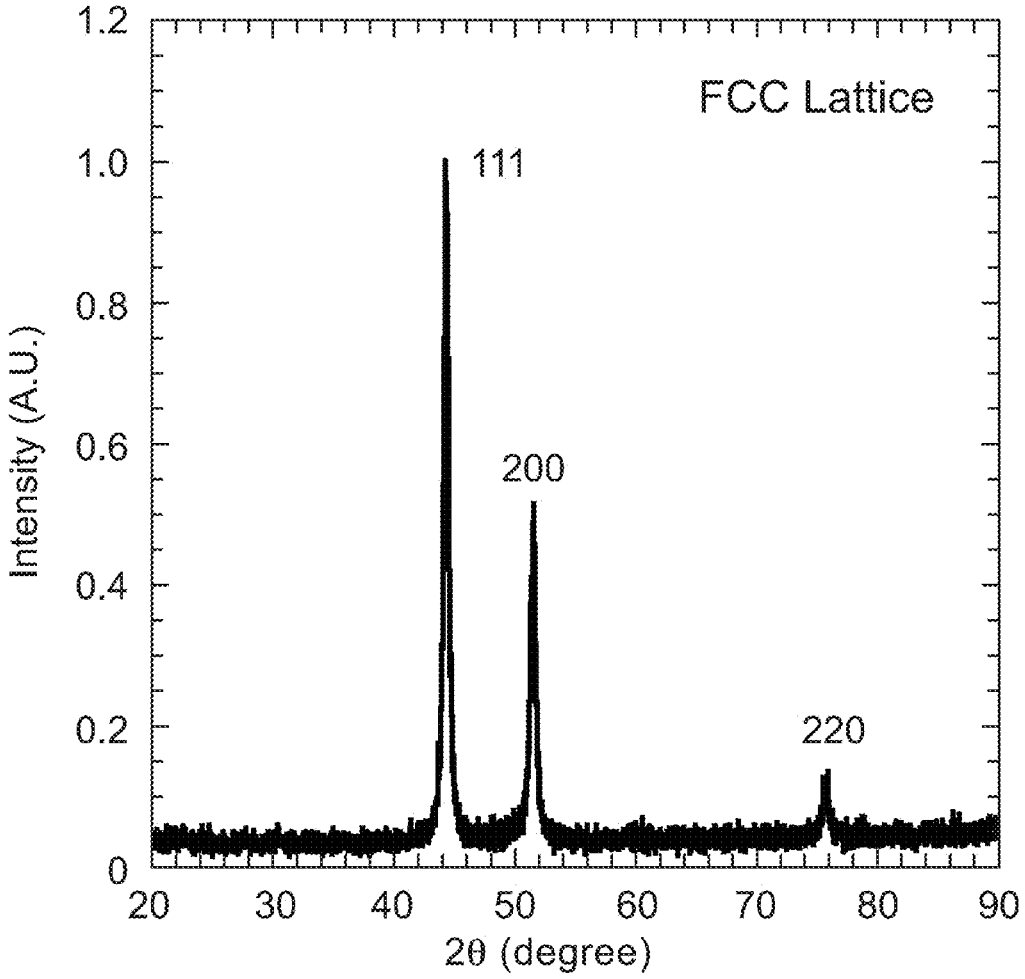
FIG. 2 is a graphic powder x-ray diffraction pattern of a single crystal FeCoNiCr alloy grown in an optical floating zone furnace showing FCC crystal structure.
Figure 3:
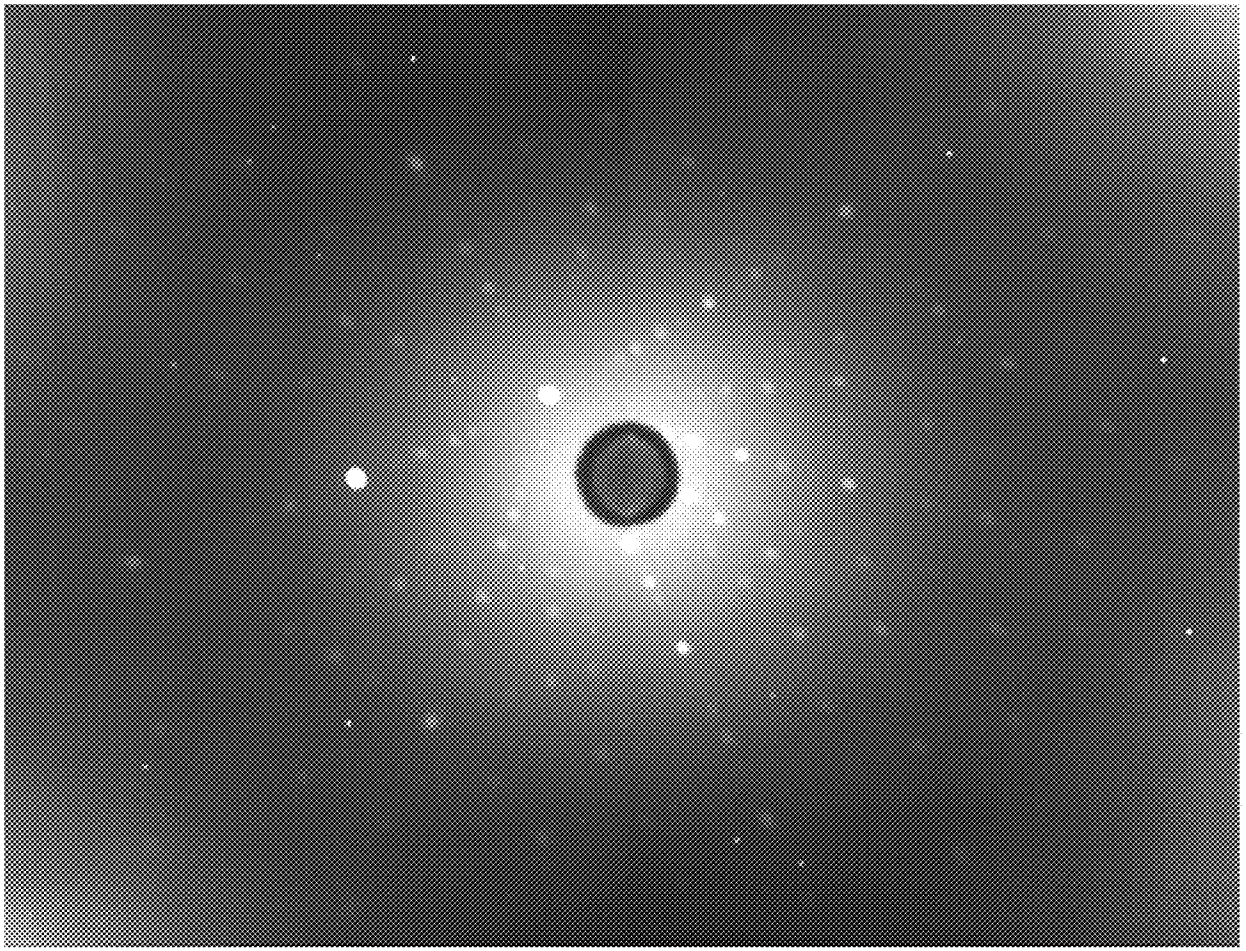
FIG. 3 is a Laue backscatter diffraction image of a single crystal FeCoNiCr alloy grown in an optical floating zone furnace showing the growth direction of FeCoNiCr is along a [001] direction.

The present invention achieves increased $\Delta S_{mix}$ by increasing the number N of the elements but still remain as a solution. However, most metals cannot be completely mixed together to form a single phase solid solution, even in binary alloys due to phase separation (e.g., Cu—Ag), and formation of intermetallic compounds (e.g., Fe—Nb). Phase separation occurs in liquid to solid transition (e.g., eutectic, peritectic and monotectic reaction) as well as solid to solid transition (e.g, eutectoid and spinodal decomposition). To date, most of HEAs previously studied were based on metallic elements of Fe, Co, Ni, Cu, Ti, Nb, Mo, V, Cr, Mn and Al. X-ray diffraction (XRD) shown in FIG. 2 and microstructure observations shown in FIGS. 1, 3 confirmed that 4-element FeCrNiCo alloy can form single phase solid solution alloy with Face-Centered-Cubic (FCC) structure and moreover single crystals of this multi-element alloy can be grown in an optical floating zone furnace.

Alloys in accordance with the present invention can be made by various conventional methods of making alloys, including arc melting. In the development and testing of the present invention, alloys were arc melted in Ar atmosphere in a water-chilled copper mold starting with essentially pure (>99.5%) elemental metals, e.g., V, Nb, Mo, Re, W, Ti, and Ta. The starting materials were carefully weighed and combined in essentially atomically equal amounts. The mixture was melted in an arc-melting apparatus by using a non-consumable tungsten electrode. Cooling the melted metal mixture resulted in a metal alloy "button".

To ensure good mixing, the buttons were turned over and re-melted at least five times prior to microstructure and x-ray diffraction examination. Total weight losses after melting were <0.1%, which led to negligible changes in the alloy composition after melting. Therefore, all compositions discussed herein are nominal compositions (atomic %) unless otherwise stated.

Figure 4:
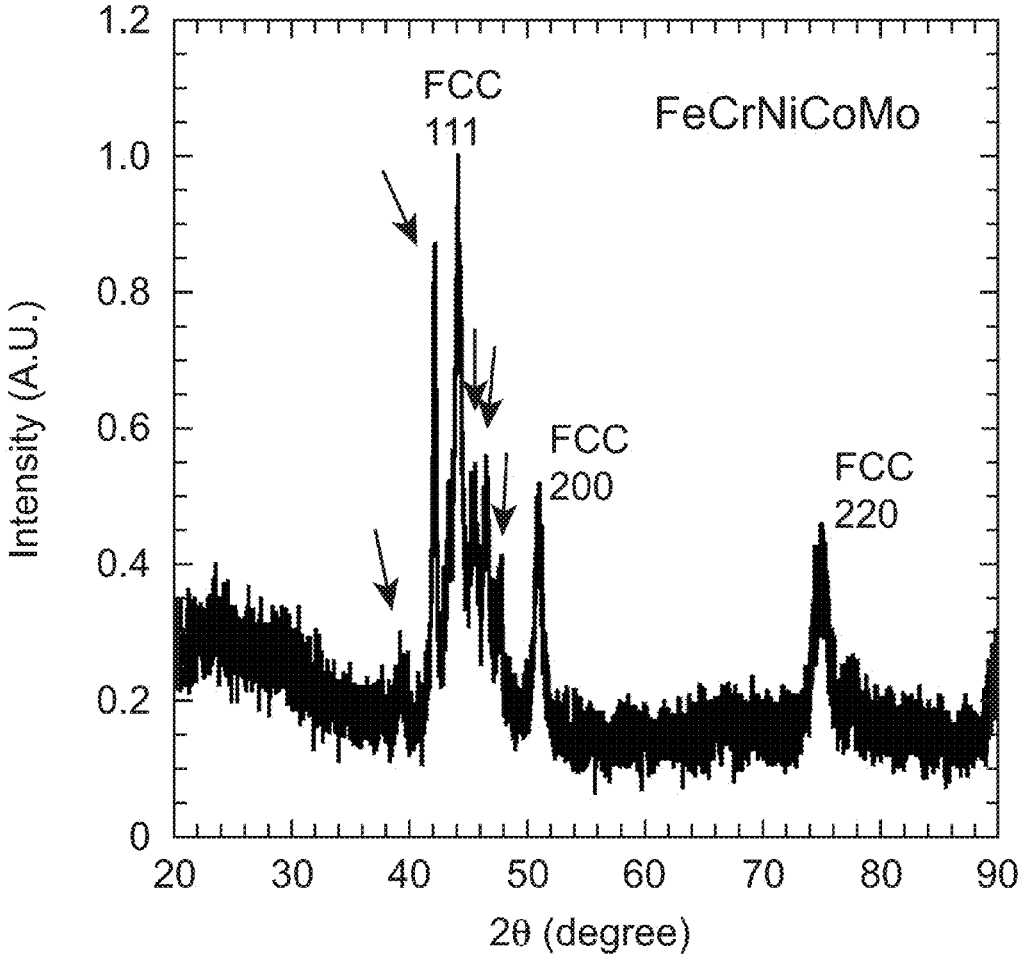
FIG. 4 is a graphic x-ray diffraction pattern of FeCrCoNiMo alloy showing that other crystal structures rather than the FCC phase exists in the material.
Figure 5:
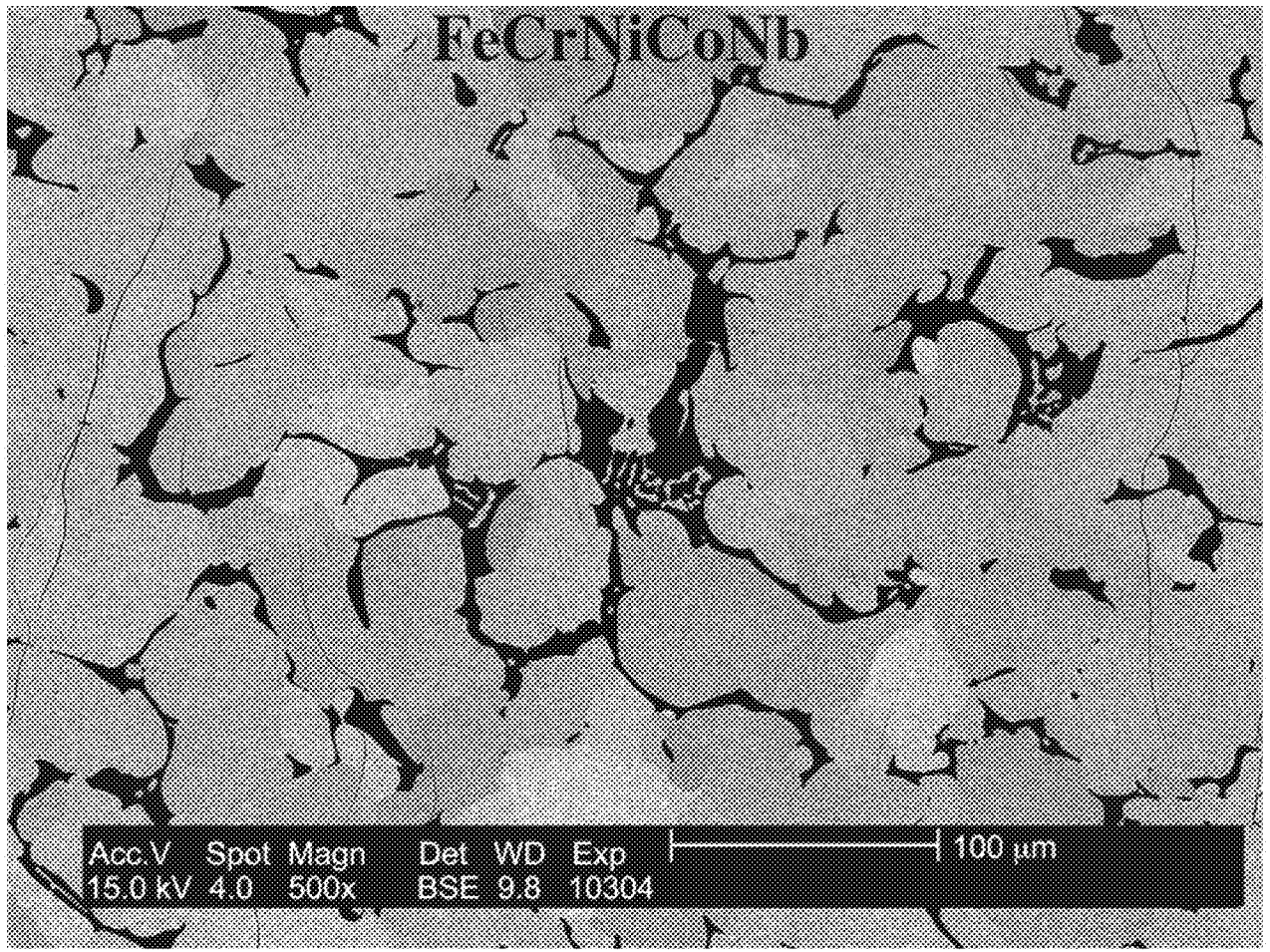
FIG. 5 is a backscattered electron image of FeCrCoNiNb alloy showing two-phase structure and thermal cracks in the light phases.

Based on the quaternary FeCoCrNi alloy, effects of the fifth element on the phase stability, micro and crystal structure were systemically investigated. By adding Ti, Nb and Mo individually into FeCrCoNi alloys, single phase solid solution cannot remain because of the formation of intermetallic compounds. XRD patterns of FeCrCoNiMo shown in FIG. 4 clearly suggested other structures rather than the FCC phase exist in the materials. SEM backscattered images of FeCrCoNiNb alloy shown in FIG. 5 indicated two-phase structure and thermal cracks in the light phases. Electron probe microanalysis (EPMA) showed that the compositions of the light and dark phases are 18Ni-20Co-24Nb-19Cr-19Fe and 24Ni-18Co-2Nb-30Cr-26Fe, respectively.

Figure 6:
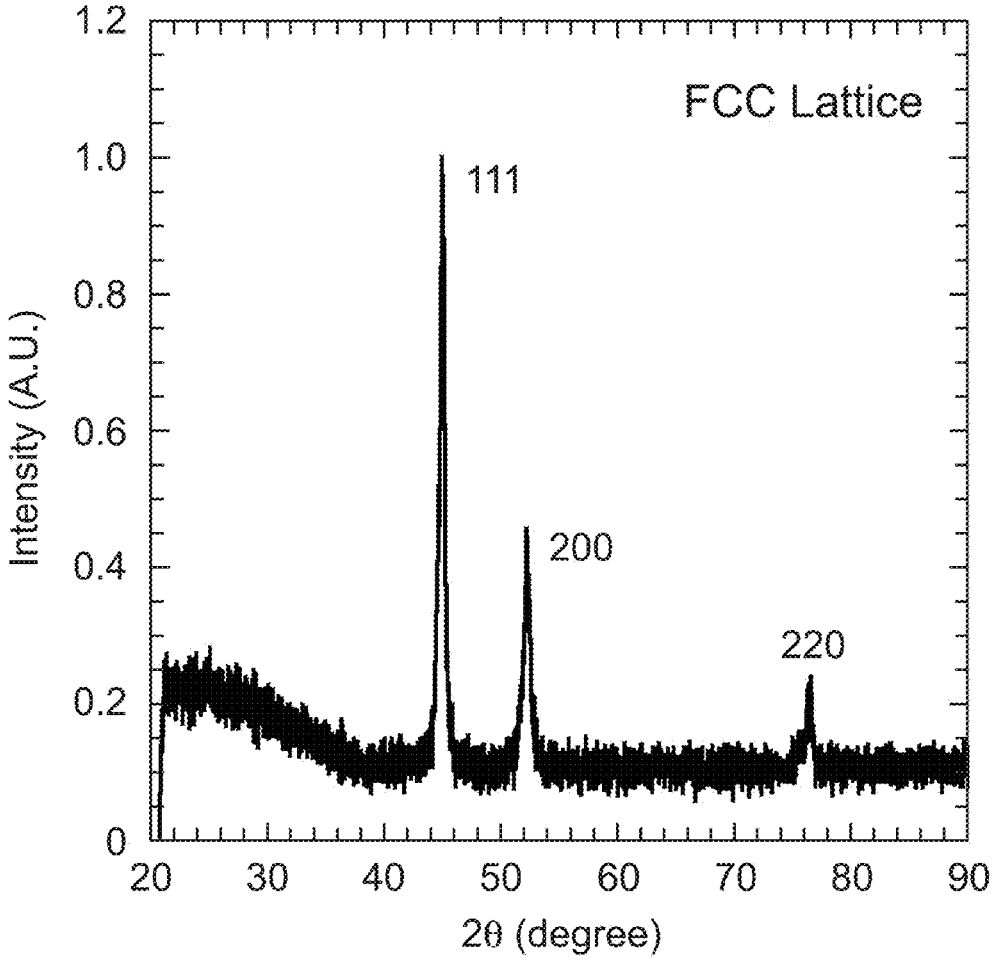
FIG. 6 is a graphic x-ray diffraction pattern showing FCC lattice in FeCoNiCrCu alloy.
Figure 7:
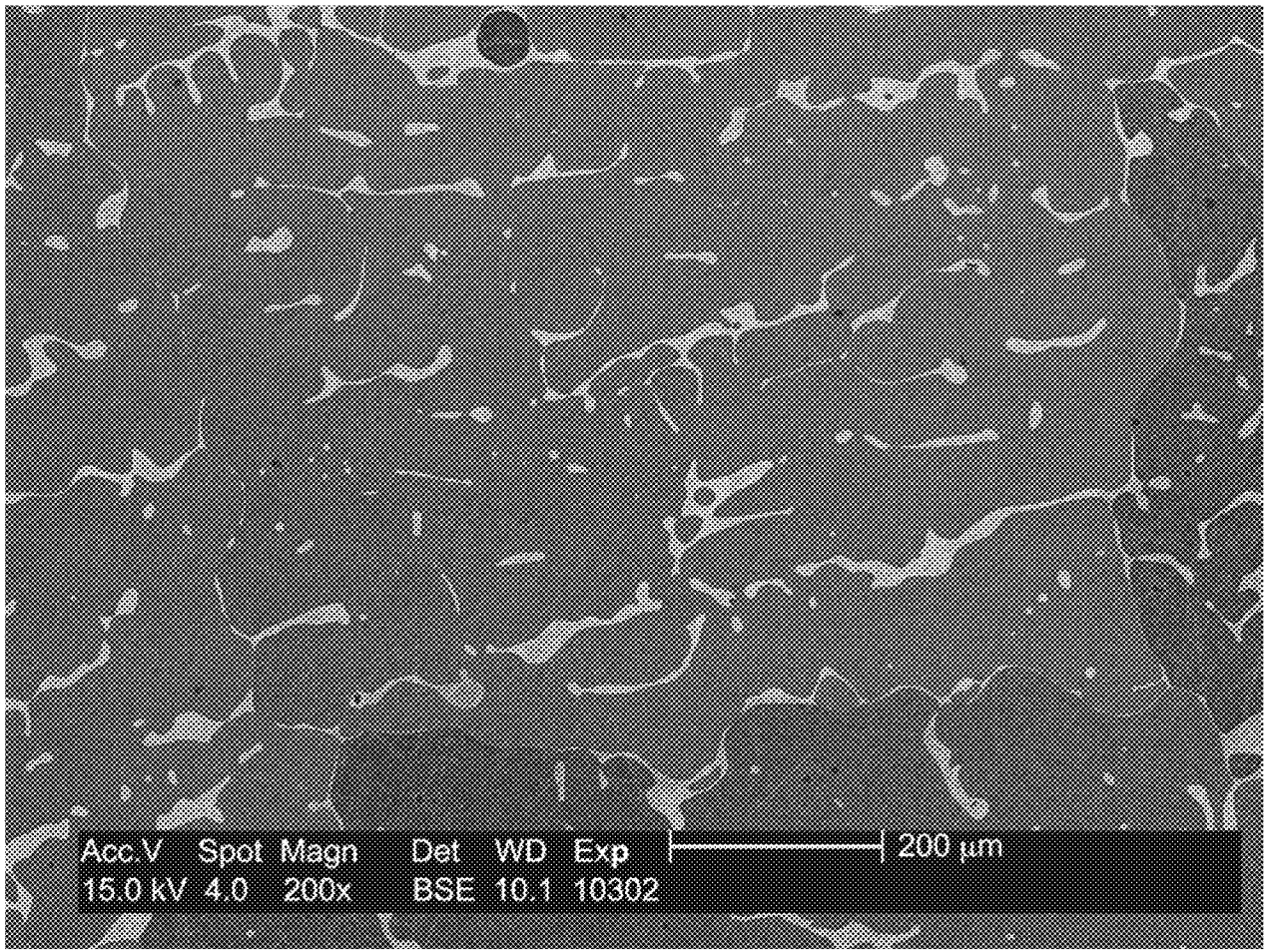
FIG. 7 is a backscattered electron image clearly indicating a two phase structure. EPMA analysis indicated that the bright and dark phases are 21Ni-23Co-10Cu-23Cr-23Fe (Cu-depleted) and 7Ni-2Co-87Cu-2Cr-2Fe (Cu-rich), respectively.
Figure 8:
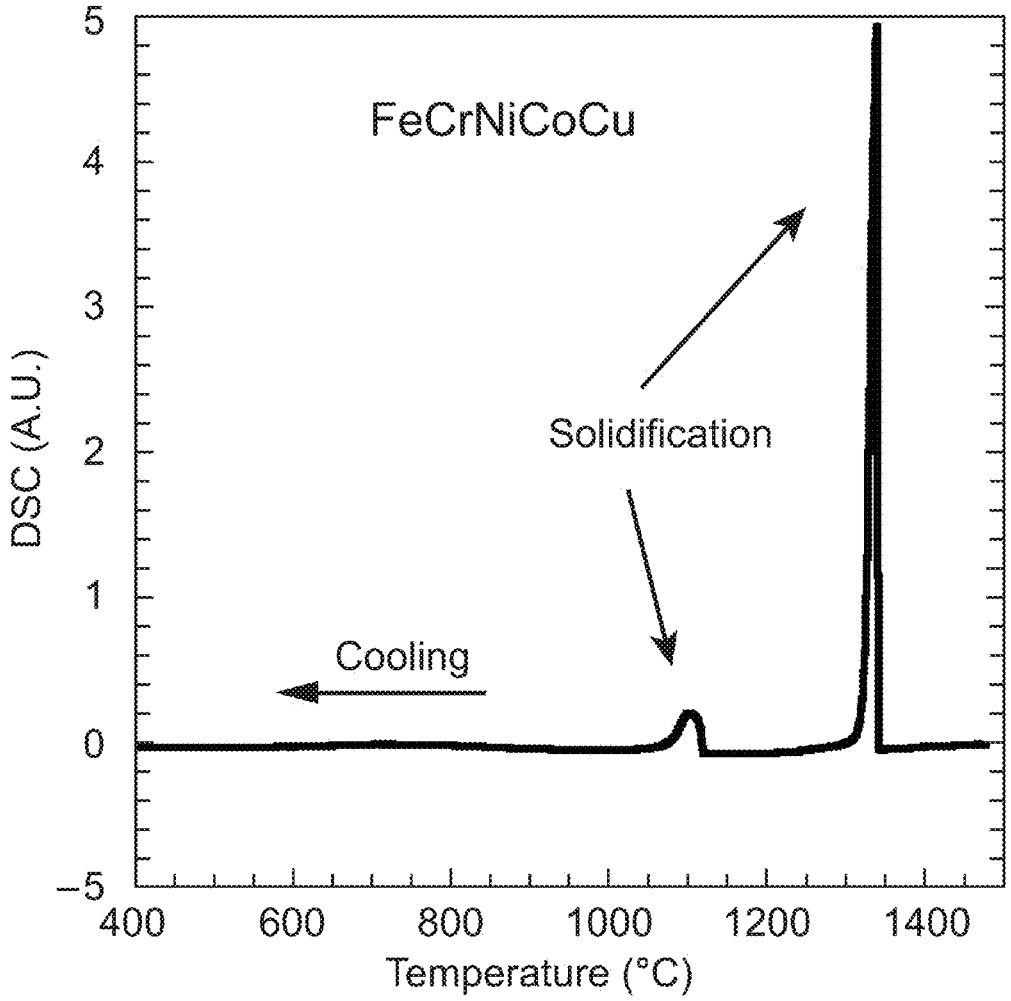
FIG. 8 is a graph of a DSC scan from liquid to 400° C. showing two solidification peaks at about 1300° C. and about 1100° C., corresponding to melting point of Cu-depleted and Cu-rich phases.

Addition of Cu into FeCrCoNi alloys showed phase separation during liquid to solid phase transition. Although XRD shown in FIG. 6 shows only FCC lattice in FeCrNiCoCu alloy, microstructural observation indicated two phase structure shown in FIG. 7 and EPMA measurement revealed that the bright and dark phases were 21Ni-23Co-10Cu-23Cr-23Fe (Cu-depleted) and 7Ni-2Co-87Cu-2Cr-2Fe (Cu-rich), respectively. FIG. 8 shows a DSC scan from liquid to 400° C. showed two solidification peaks at about 1300° C. and about 1100° C., corresponding to melting point of Cu-depleted and Cu-rich phases, respectively.

Figure 9:
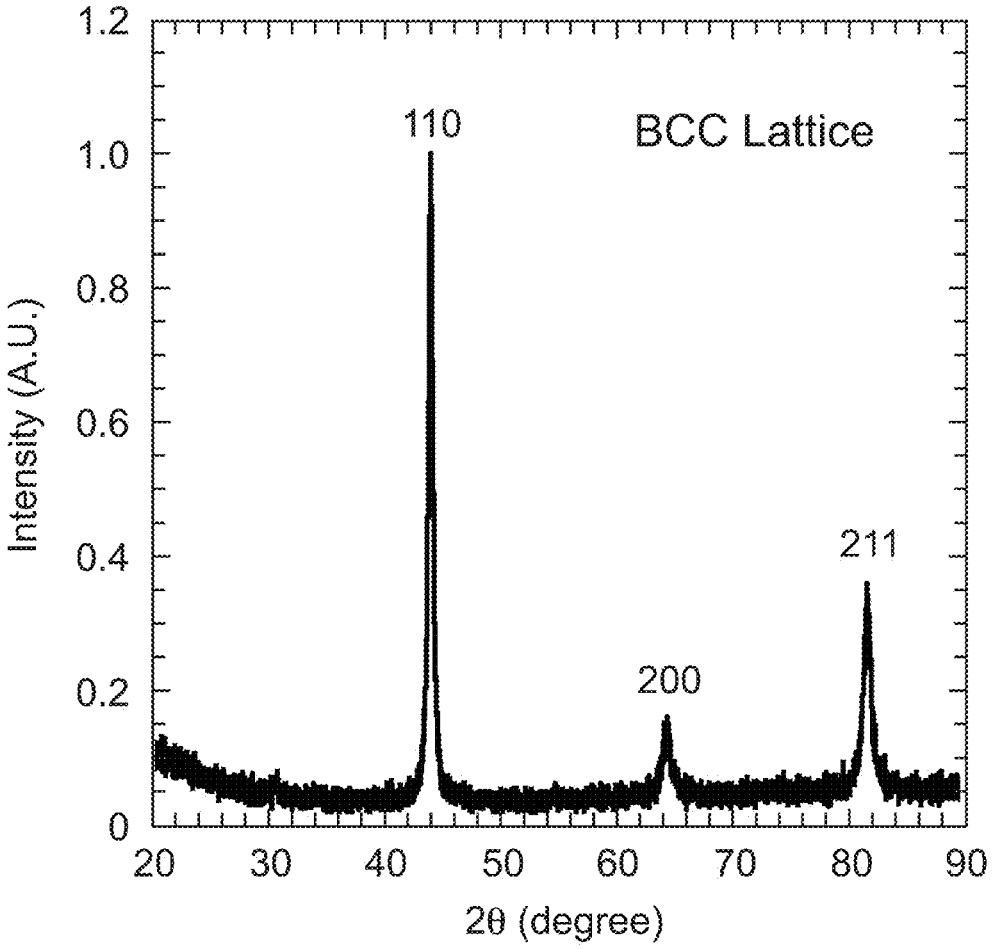
FIG. 9 is a graphic x-ray diffraction pattern shows only BCC lattice in FeCrNiCoAl alloy.
Figure 10:
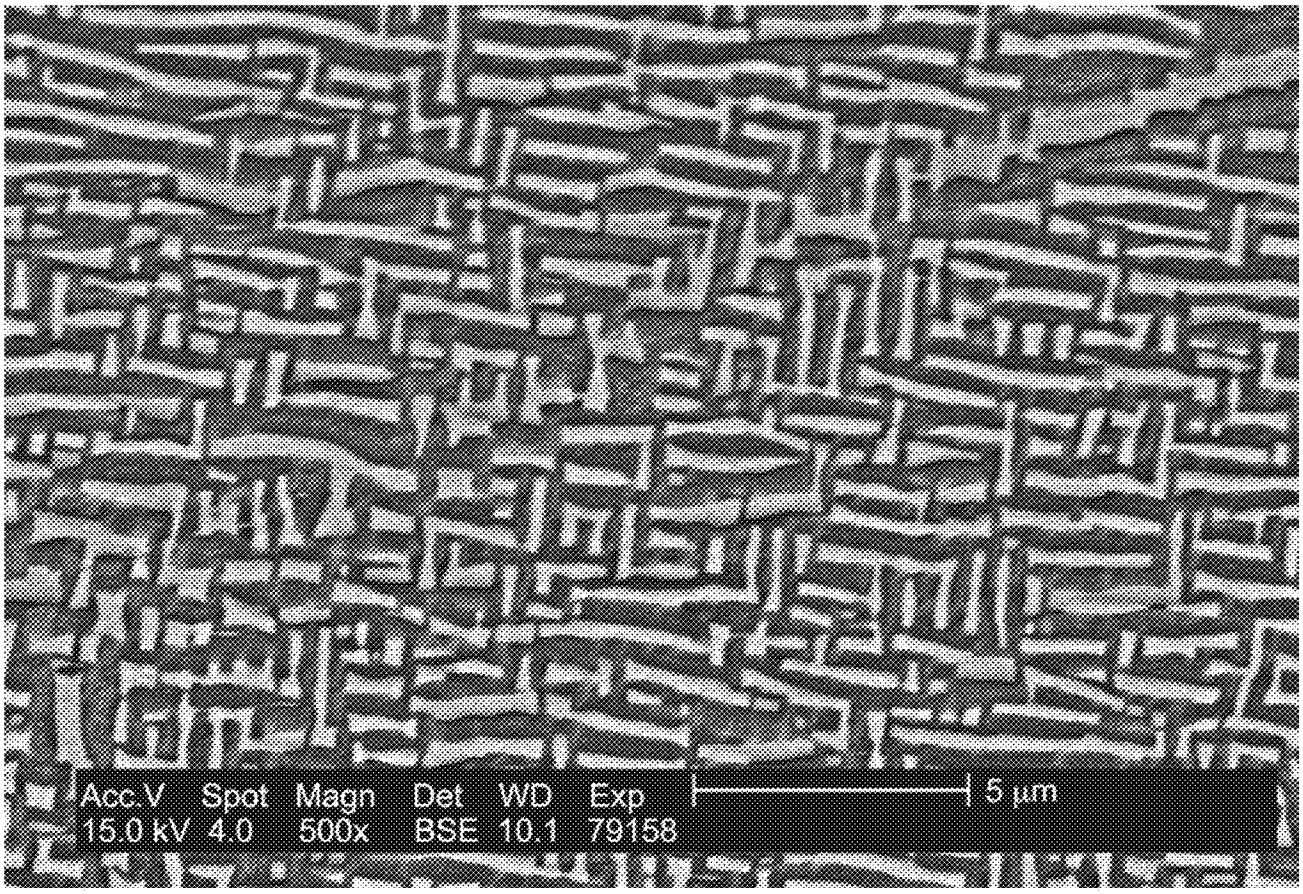
FIG. 10 is a backscattered electron image clearly indicating a two phase structure. EPMA analysis indicated that the bright and dark phases are 12Ni-21Co-9Al-32Cr-26Fe (NiAl-depleted) and 23Ni-19Co-24Al-16Cr-18Fe (NiAl-rich), respectively.
Figure 11:
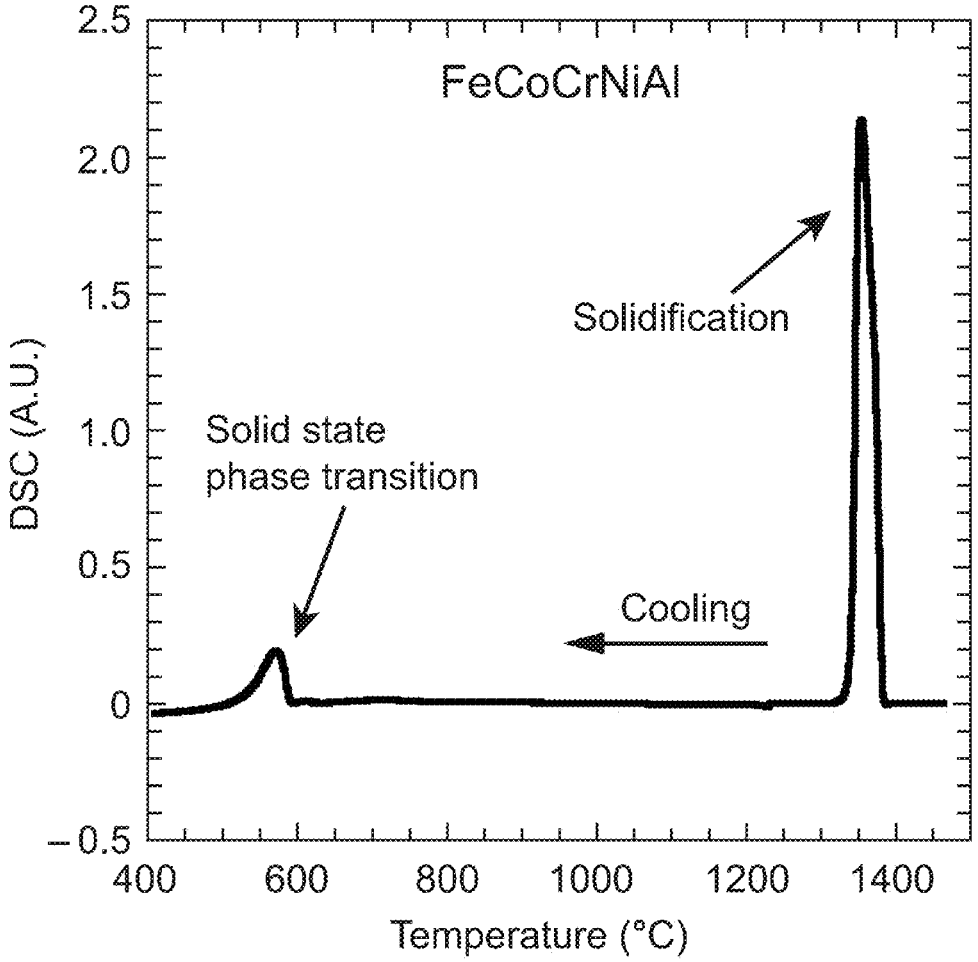
FIG. 11 is a graph of a DSC scan from liquid to 400° C. showing a solid-state phase transition at about 550° C.

A single phase solid solution cannot remain when adding Al into FeCrCoNi alloy because of phase separation during solid to solid phase transition. Although XRD shown in FIG. 9 of FeCrCoNiAl alloy showed only BCC lattice, microstructural observation shown in FIG. 10 indicated two phase structure and EPMA analysis indicated that the bright and dark phases are 12Ni-21Co-9Al-32Cr-26Fe (NiAl-depleted) and 23Ni-19Co-24Al-16Cr-18Fe (NiAl-rich), respectively. FIG. 11 shows a DSC scan from liquid to 400° C. indicating a solid state phase transition at about 550° C.

Figure 12:
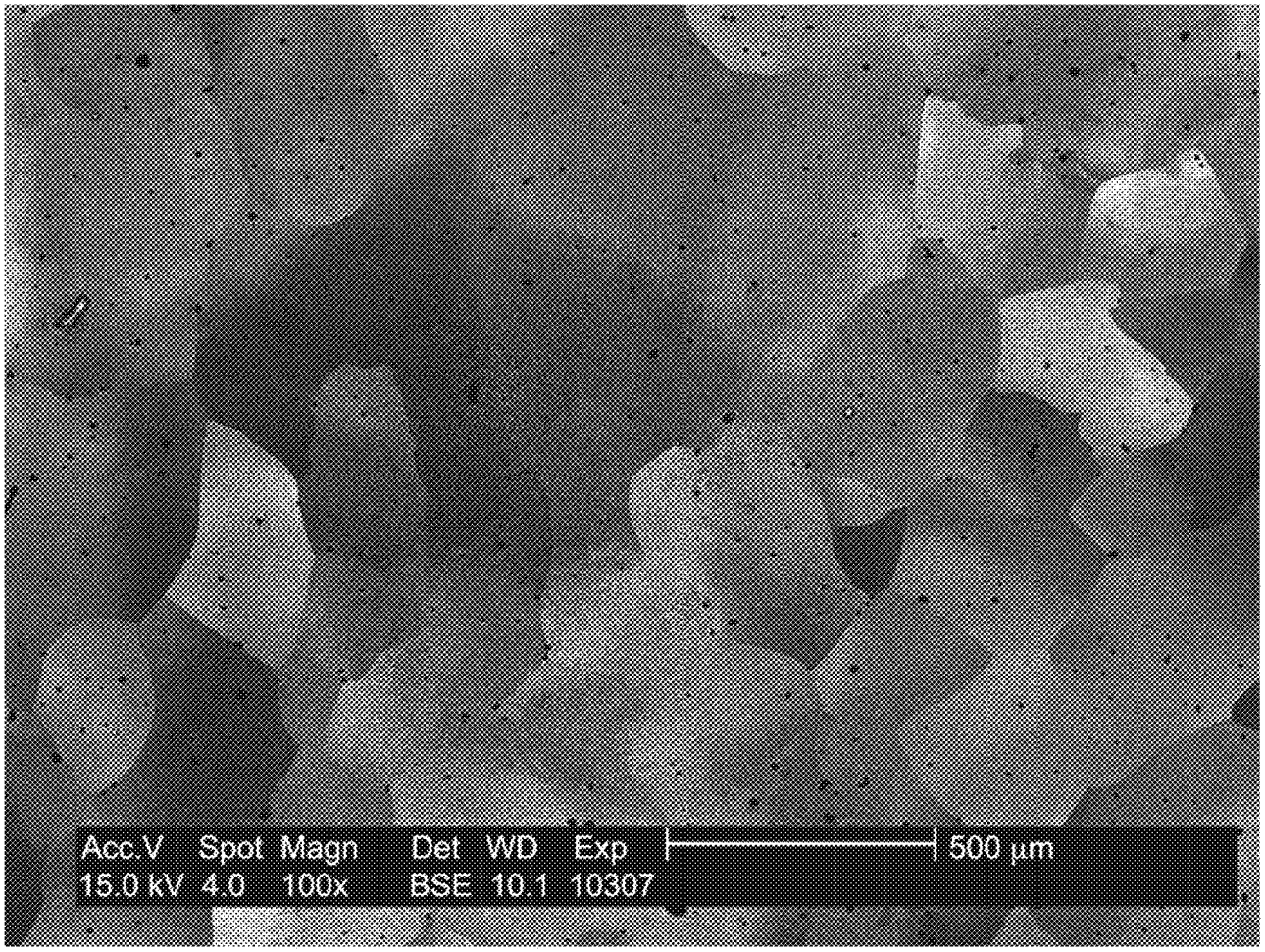
FIG. 12 is a backscattered electron image showing a single phase polycrystalline structures in a FeCrNiCoMn alloy.
Figure 13:
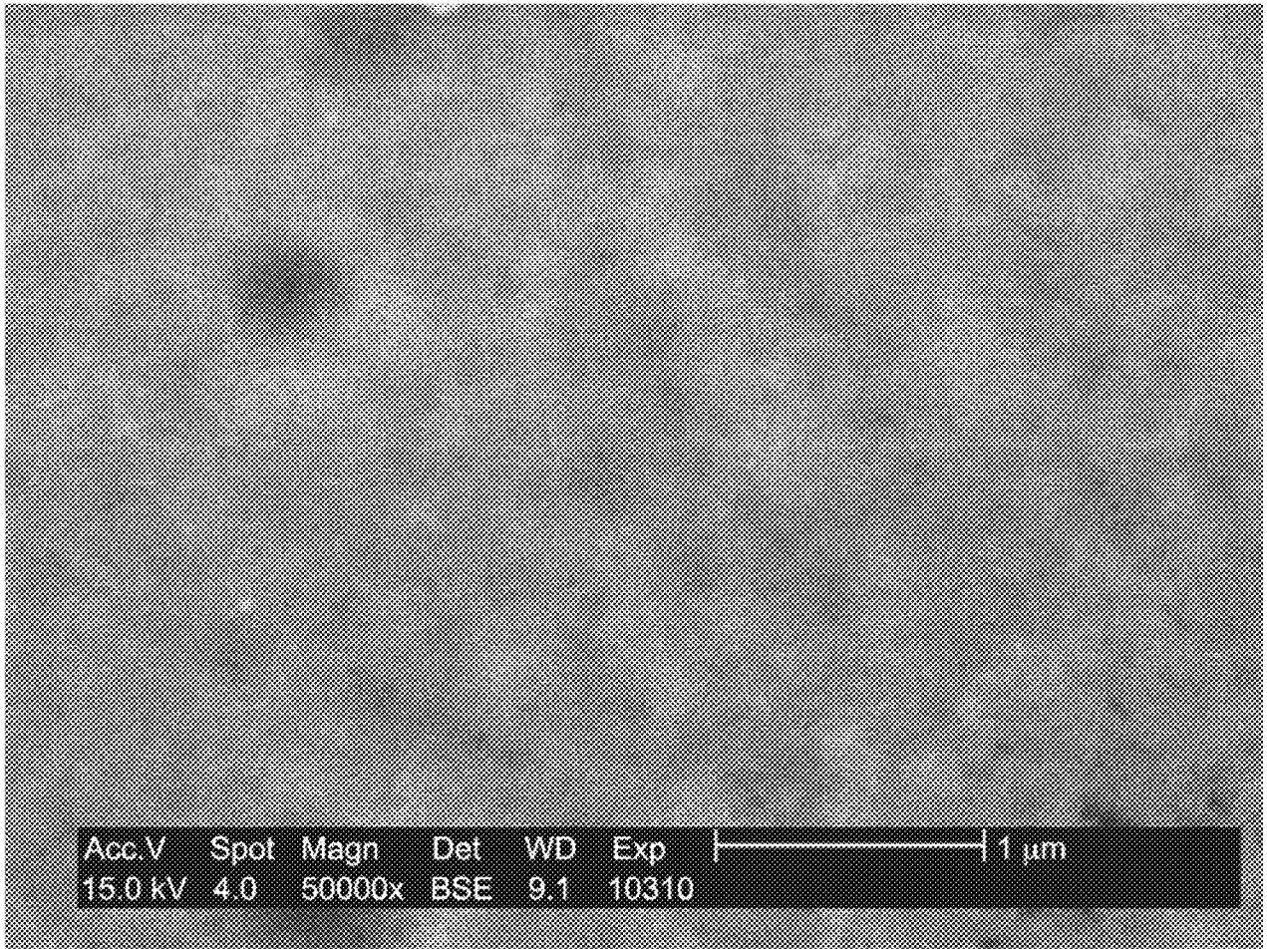
FIG. 13 is a high-magnification BSE image showing no phase separation in micrometer-scale.

In contrast, addition Mn into FeCoNiCr alloy produced a real single phase solid solution in alloy systems based on elements of Fe, Co, Ni, Cu, Ti, Nb, Mo, Cr, Mn and Al. SEM images of FeCrNiCoMn alloys shown in FIGS. 12, 13 indicated that a single phase solid-solution remains in this five-component alloy.

Above experiments suggested that single phase multi-component solid solution alloys can only be obtained without phase separation and formation of the intermetallic compounds. In principal, if phase diagrams comprises all multi-component elements were accurate and available, finding of the multi-component single phase solid solution HEAs should be straightforward. However, in practice, there are still limited data when phase diagrams comprises more than three elements. Accordingly, a guideline based on binary phase diagrams (data of binary phase diagram is the most comprehensive) was proposed, which thus can be practically applied to multi-component alloy systems.

A guideline or making new, multiphase HEAs is based on an understanding of the successful single phase HEAs. Firstly, at least at high temperature, each pair of elements in the alloy must have sufficiently large solid solution regions (typically, over 25 at. %) in binary systems. Secondly, intermetallic compounds formed by these elements must be minimized. For example, FIG. 14 is a solubility table of Ni, Co, Mn, Cr, Fe, Au, Al and Nb. Symbol "-" represents very large solid solubility in both side in a binary phase diagram, 5 e.g., Ni—Co. Symbol "/" represents very large solid solubility only in one side, e.g., Cr—Mn. Symbol "X" refers to small solubility either due to phase separation or formation of intermetallic compounds, e.g., Fe—Cu, Fe—Nb, etc. The region with symbol "-" and "/" is the possible elements, FeCeNiCoMn alloy, which was confirmed in FIGS. 12, 13.

This strategy can be used not only to understand the formation of single-phase solid solution HEAs but also to discover new family of HEAs. Application of this method to elements of Ti, Zr, Hf, V, Nb, Ta, Cr, Mo, W and Re is schematically shown in FIG. 15. It is predicated that alloys based on seven elements —V, Nb, Ta, Mo, W, Ti and Re can form many single phase solid solution HEAs. For example, if only alloys with more than 4 elements are considered, the newly-discovered family comprises one 7-element, seven 6-element and twenty-one 5-element HEAs. Six alloys (one 7-element, two 6-element and three 5 element) were selected to conduct experimental testing on composition, crystal structure, microstructure and mechanical properties.

Figure 16:
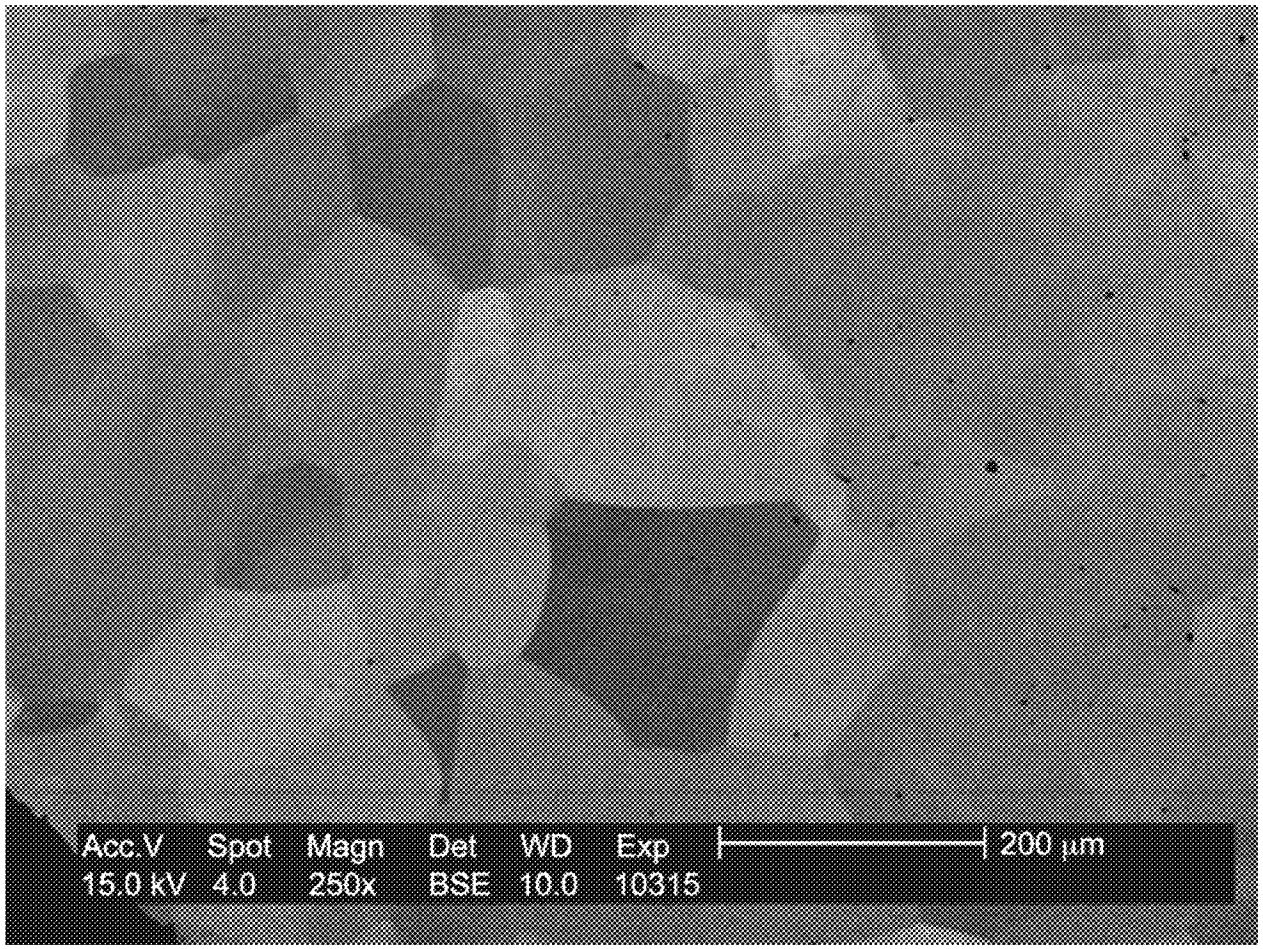
FIG. 16 is a backscattered electron image showing single phase polycrystalline structures in 7-element VNbTaMoWTiRe alloy.
Figure 17:
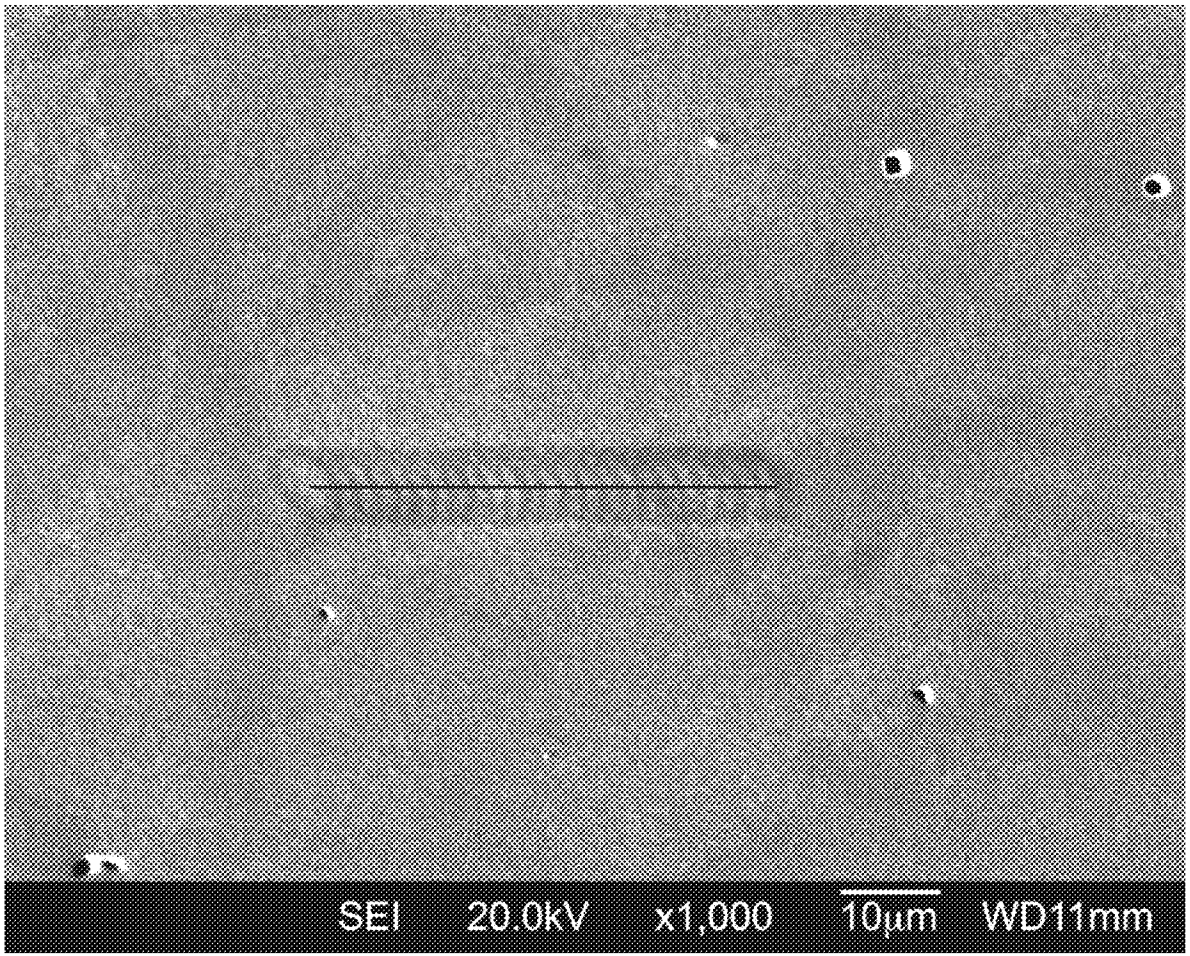
FIG. 17 is a high-magnification second electron image of VNbTaMoWTiRe showing the location of EPMA line scan (black line).
Figure 18:
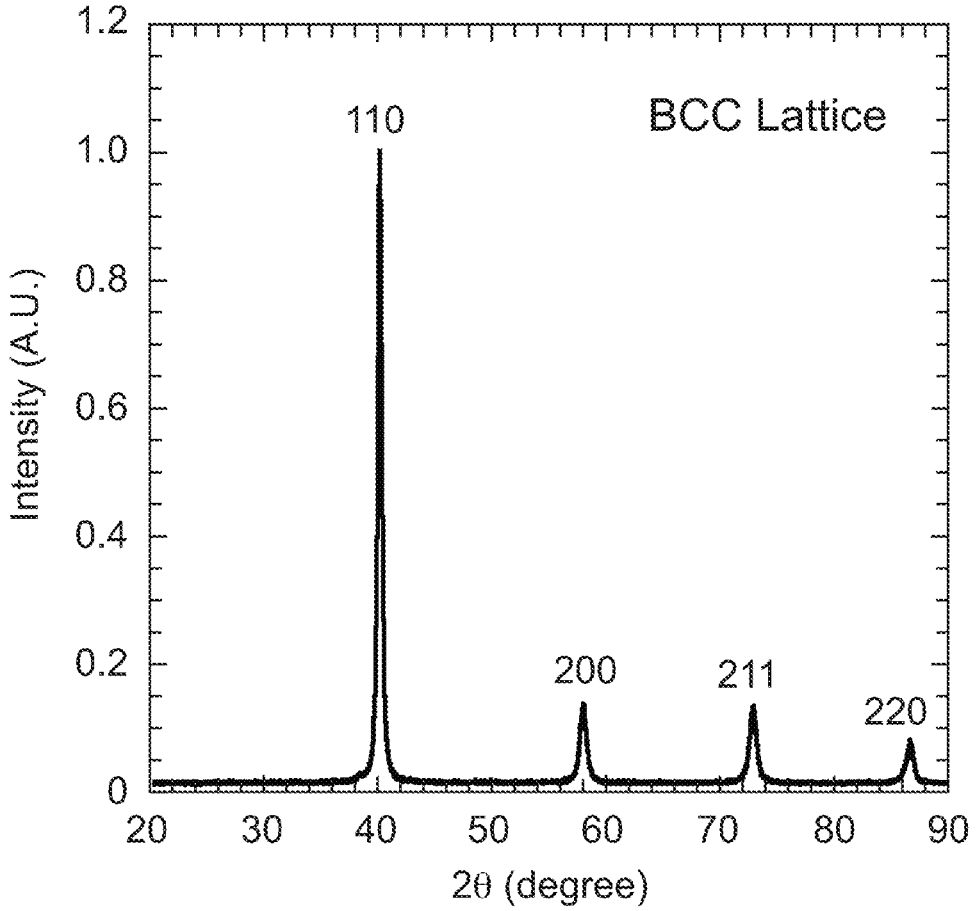
FIG. 18 is a graphic powder x-ray diffraction pattern of VNbTaMoWTiRe showing BCC crystal structure.

Single-phase polycrystalline microstructures of the 7-element VNbTaMoWTiRe alloy is shown in FIG. 16, indicting absence of phase separation and second phases. EPMA line scan (locations are shown in FIG. 17) indicated that the composition was homogeneous. X-ray diffraction shown in FIG. 18 indicated simple BCC structure of this alloy. Collectively, it is experimentally confirmed that VNbTaMoWTiRe alloy is solid solution HEA. Similar experimental results revealed that other 5 selected alloys are also single phase solid solution HEAs with BCC crystal structure.

The new family of multi-component solid solution HEAs of the present invention represents tectonically important structure materials. These alloys mainly comprise refractory metal elements, thus their melting temperature is very high, which is important for high-temperature structural using or heating elements. Some alloys, which mainly comprise W, Mo, Ta and Re, have very high density (comparable to commercial high density W-alloy). High density alloys are crucial for developing materials with high penetration capability, e.g., bullet into concrete. Nanoindentation experiments were conducted to measure the modulus and hardness of selected new HEAs (shown in Table 1). Hardness and modulus can be changed in a large range in different alloys. Some alloys have very high hardness, as high as 10.5 GPa (~3 times of pure Mo, ~2 times of pure W), suggesting a high strength of the material.

TABLE 1

| Sample | Composition | Modulus (GPa) | Hardness (GPa) |
|---|---|---|---|
| Alloy 1 | VNbTaMoTi | 171 ± 4 | 5.6 ± 0.1 |
| Alloy 2 | VNbTaTiRe | 230 ± 7 | 9.7 ± 0.2 |
| Alloy 3 | NbMoTaReW | 355 ± 15 | 8.0 ± 0.1 |
| Alloy 4 | VNbMoTaTiW | 216 ± 6 | 7.7 ± 0.2 |
| Alloy 5 | VNbMoTaReW | 328 ± 13 | 10.5 ± 0.3 |
| Alloy 6 | VNbTaTiMoReW | 271 ± 11 | 9.6 ± 0.2 |

In Summary, the stability of multi-component single phase high-entropy alloys (HEAs) comprises five or more metallic elements, is competed with phase separation and formation of intermetallic compound. Using a combination of thermodynamic modeling and experiments, a simple criterion to identify single phase solid solution HEAs was developed. Careful experiment on micro/crystal structure of the selected alloys revealed the newly discovered alloys have BCC crystal structure. These alloys display various interesting physical and mechanical properties, which may be useful to many fields.

A new family of single phase solid solution HEA is discovered, which comprises various combinations of V, Nb, Ta, Ti, Mo, W and Re. Only alloys with more than four elements are considered because, according to the equation $\Delta S_{mix}$=RInN discussed hereinabove, mixing entropy for 4 element is less than 1.6R. By definition only alloys with mixing entropy larger than 1.6R are considered. Thus, the new family of alloys encompassed by the present invention comprises one 7-element, seven 6-element and twenty-one 5-element HEAs, which are set forth hereinbelow. For all of the compositions of the present invention, relative amounts of each element are ideally about atomically equal, but can vary, preferably no more than ±15 atomic %, more preferably no more than ±10 atomic %, most preferably no more than ±5 atomic %.

Compositions that fall within the scope of the present invention include the following: (i) one 7-element alloy: VNbTaTiMoWRe; (ii) Seven 6-element alloys: VNbTaTiMoW, VNbTaTiMoRe, VNbTaTiWRe, VNbTaMoWRe, VNbTiMoWRe, VTaTiMoWRe, NbTaTiMoWRe; and (iii) twenty-one 5-element alloys: VNbTaTiMo, VNbTaTiW, VNbTaMoW, VNbTiMoW, VTaTiMoW, NbTaTiMoW, VNbTaTiRe, VNbTaMoRe, VNbTiMoRe, VTaTiMoRe, NbTaTiMoRe, VNbTaWRe, VNbTiWRe, VTaTiWRe, NbTaTiWRe, VNbMoWRe, VTaMoWRe, NbTaMoWRe, VTiMoWRe, NbTiMoWRe, TaTiMoWRe.

While there has been shown and described what are at present considered to be examples of the invention, it will be obvious to those skilled in the art that various changes and modifications can be prepared therein without departing from the scope of the inventions defined by the appended claims.

What is claimed is:

1. A multi-component single phase high-entropy alloy consisting of a solid solution composition selected from the group consisting of: VNbTaTiMoWRe, VNbTaTiMoRe, VNbTaTiWRe, VNbTaMoWRe, VNbTiMoWRe, VTaTiMoWRe, NbTaTiMoWRe, VNbTaTiRe, VNbTaMoRe, VNbTiMoRe, VTaTiMoRe, NbTaTiMoRe, VNbTaWRe, VNbTiWRe, VTaTiWRe, NbTaTiWRe, VNbMoWRe, VTaMoWRe, NbTaMoWRe, VTiMoWRe, NbTiMoWRe, TaTiMoWRe, wherein relative amounts of each element vary by no more than 5 atomic %, the alloy having a mixing entropy greater than 1.6R.

2. A multi-component single phase high-entropy alloy consisting of a solid solution composition selected from the group consisting of: VNbTaTiMoW, VNbTaTiMo, VNbTaTiW, VNbTaMoW, VNbTiMoW, VTaTiMoW, NbTaTiMoW, wherein relative amounts of each element vary by no more than 5 atomic %, the alloy having a mixing entropy greater than 1.6R.

* * * * *